US005558234A

United States Patent [19]

Mobley

[11] Patent Number: 5,558,234

[45] Date of Patent: Sep. 24, 1996

[54] PRODUCT SIZE GRADING SYSTEM

[76] Inventor: John E. Mobley, 20571 Empire Ave., Bend, Oreg. 97701

[21] Appl. No.: 278,716

[22] Filed: Jul. 22, 1994

[51] Int. Cl.[6] ..... B07B 13/075

[52] U.S. Cl. ..... 209/671; 209/672; 209/684; 198/577; 198/784; 198/790

[58] Field of Search ..... 209/659, 666, 209/667, 671, 672, 673, 684, 686; 198/459.1, 461.1, 577, 579, 780, 784, 789, 790

[56] References Cited

U.S. PATENT DOCUMENTS

| | | | |
|---|---|---|---|
| 1,418,899 | 6/1922 | Acken | 209/671 |
| 2,670,846 | 3/1954 | Rienks et al. | 209/672 X |
| 2,674,179 | 4/1954 | Harrington | 198/790 X |
| 3,011,211 | 12/1961 | Barns | 198/784 X |
| 3,306,477 | 2/1967 | Wriedt | 198/579 X |
| 4,901,864 | 2/1990 | Daugherty | 209/667 X |
| 5,051,172 | 9/1991 | Gilmore | 209/672 |
| 5,279,427 | 1/1994 | Mobley | 209/672 X |

FOREIGN PATENT DOCUMENTS

| | | | |
|---|---|---|---|
| 646931 | 10/1992 | Australia | 209/671 |

*Primary Examiner*—William E. Terrell
*Assistant Examiner*—Tuan Nguyen
*Attorney, Agent, or Firm*—Chernoff, Vilhauer, McClung & Stenzel

[57] ABSTRACT

A product size grading system comprises a roller bed having a plurality of rotary shafts wherein each shaft supports product sizing roller members. A motorized transmission is coupled to the plurality of rotary shafts and drives the rotary shafts in a uniform direction wherein each shaft in the roller bed rotates at a different speed. The speeds of the rotary shafts become progressively faster from the input end of the roller bed to its output end. The roller members comprise alternating conveyor disks and nubbin rollers threaded onto each of the rotary shafts. The nubbin rollers are relatively thick disks having a substantially polygonal cross section with flexible nubbins or vanes projecting radially outwardly therefrom. Each nubbin roller is sandwiched by a pair of thin conveyor disks which are also generally polygonal in shape, but have rounded crown portions between their flat portions. The combination of the nubbin rollers and the conveyor disks form product sizing pockets. Undersized product falls into these pockets and is dropped below the roller bed.

6 Claims, 5 Drawing Sheets

PRODUCT SIZE GRADING SYSTEM

BACKGROUND OF THE INVENTION

The following invention relates to a product size grading system and more particularly to a system employing a roller table having a progressive speed transmission system and flexible nubbin rollers for sizing the product as it is conveyed across the roller table.

Size grading systems of the type that are used for sizing food product typically consist of vibratory conveyor screens having slots or holes of a predetermined size so that undesirably sized pieces of food product (such as those that are cut too short, slivers and fines) fall through the slots as the product is conveyed by vibratory action. The problem with such devices is that undesirable product pieces are not likely to fall through the slots or holes in the vibratory conveyor screen unless they are properly aligned. In theory, at least vibration eventually aligns these pieces over a slot or hole at some point during travel, but as a practical matter this does not always occur. In addition with such devices, product of the proper length may become oriented endwise up and unintentionally slip through the slots or holes. Also, curved or bent pieces of product will in most cases pass through screens or holes. Such product is, however, useful and the mis-sizing caused by the screen is wasteful. In addition, vibratory screens take up an inordinate amount of floor space and are noisy.

Conventional roller beds have also been employed in the past for removing fines and slivers but are inadequate for properly sizing product. Roller beds frequently employ angled rollers which can also mash or otherwise damage properly sized product.

SUMMARY OF THE INVENTION

The present invention provides a product size grading system comprising a roller bed having a plurality of rotary shafts wherein each shaft supports product sizing roller members. A motorized transmission is coupled to the plurality of rotary shafts and drives the rotary shafts in a uniform direction wherein each shaft in the roller bed rotates at a different speed. The speeds of the rotary shafts become progressively faster from the input end of the roller bed to its output end.

According to another aspect of the invention, the roller members comprise alternating conveyor disks and nubbin rollers threaded onto each of the rotary shafts. The nubbin rollers are relatively thick disks having a substantially polygonal cross section with flexible nubbins or vanes projecting radially outwardly therefrom. Each nubbin roller is sandwiched by a pair of thin conveyor disks which are also generally polygonal in shape, but have rounded crown portions between their flat portions. The combination of the nubbin rollers and the conveyor disks form pockets having a lengthwise dimension substantially equal to the distance between the nubbins or vanes and a cross wise dimension that is substantially equal to the thickness of the nubbin roller. Undersized product falls into these pockets and is dropped below the roller bed as the roller rotates.

The nubbins or vanes are inclined at a slight angle in a lagging direction to the direction of rotation. This angle is typically about 10°. This ensures that the nubbins which are flexible, preferably a flexible and resilient rubber, will not damage the product if product becomes pinched in the gap between adjacent rollers. In addition, the speed differentials of the shafts ensure that product that becomes oriented endwise in the gaps between adjacent rollers does not become mis-sized. The faster speed of the downstream roller will kick the product forward before the previous roller can press it into the gap where it could otherwise become mis-sized. In addition, the flat and crown portions of the conveyor disks help to effectively convey product which is lying crosswise to the roller bed, down the roller bed without damage in a manner similar to that illustrated in my U.S. Pat. No. 5,279,427.

The speed differential for progressively downstream roller shafts is accomplished by a motorized transmission comprising a chain and sprocket system. A lead drive roller shaft at the output end of the roller bed includes a toothed sprocket and a chain. The chain is looped over similar toothed sprockets for each of the other roller shafts where each progressively upstream sprocket has more teeth than the previous one. Thus, each upstream roller shaft turns slightly slower than its next adjacent downstream roller shaft.

The system is less than 10% as noisy as a vibratory sizer, takes up less floor space, and wastes less properly sized product.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
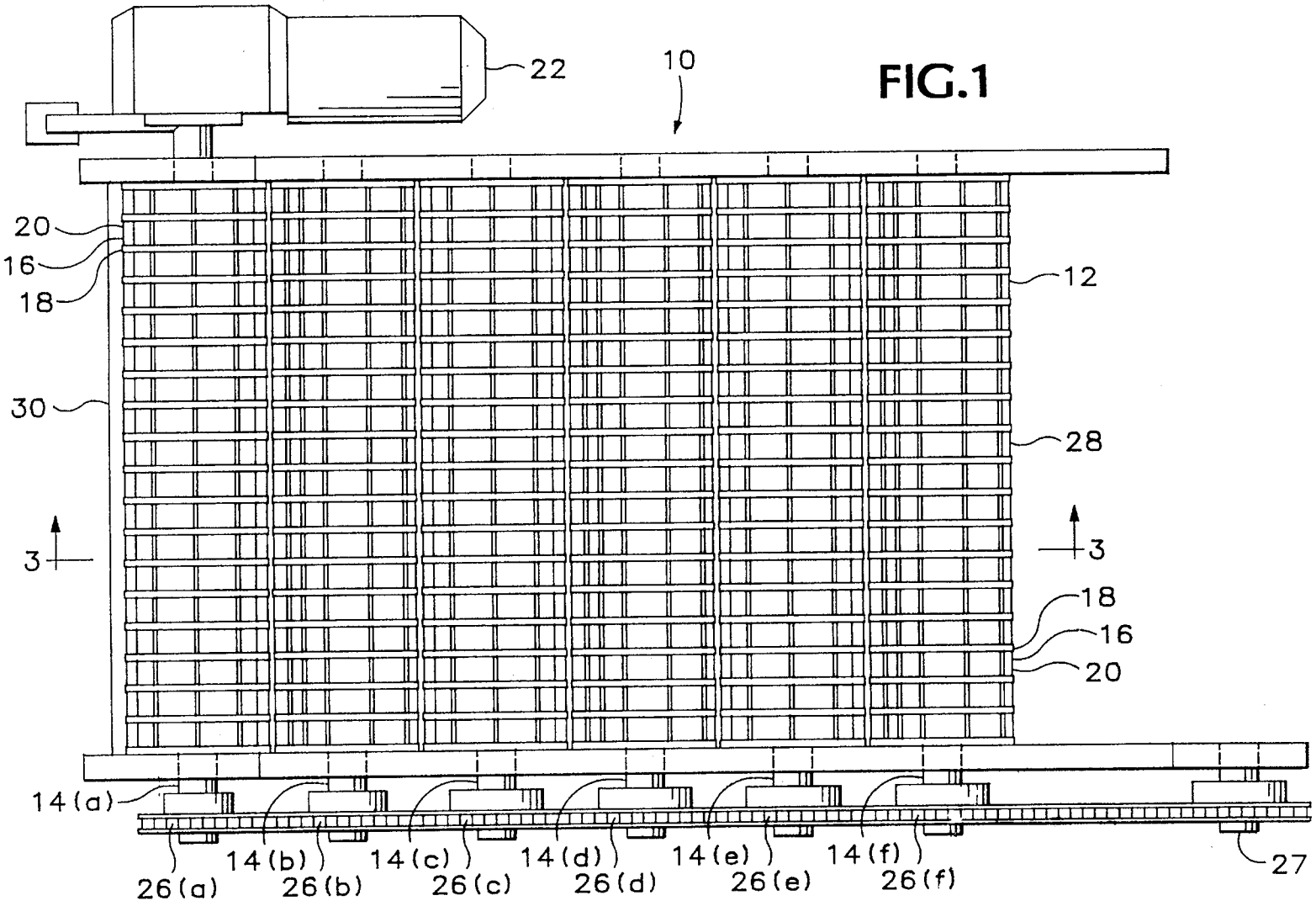
FIG. 1 is a top view of the product size grading system employing the present invention.

Referring now to FIG. 1 a product size grading system 10 includes a roller bed 12 having a plurality of rotary shafts 14(*a*)–14(*f*). Each of the rotary shafts 14(*a*)–14(*f*) include roller members 16 which comprise, alternately, a conveyor disk 18 and a nubbin roller 20. The drive shaft 14(*a*) is coupled to a motor 22. The drive shaft 14(*a*) is coupled to the remaining rotary shafts 14(*b*)–14(*f*) by a chain 24 which is looped over sprockets 26(*a*)–26(*f*) at the ends of the drive shafts and an idler 27 as will be explained below.

The roller bed 12 has an input end 28 and an output end 30. Product deposited at the input end 28 travels across the roller bed towards the output end 30 under the uniform rotary motion imparted by drive shaft 14(*a*) to the other rotary shafts 14(*b*)–14(*f*).

Figure 2:
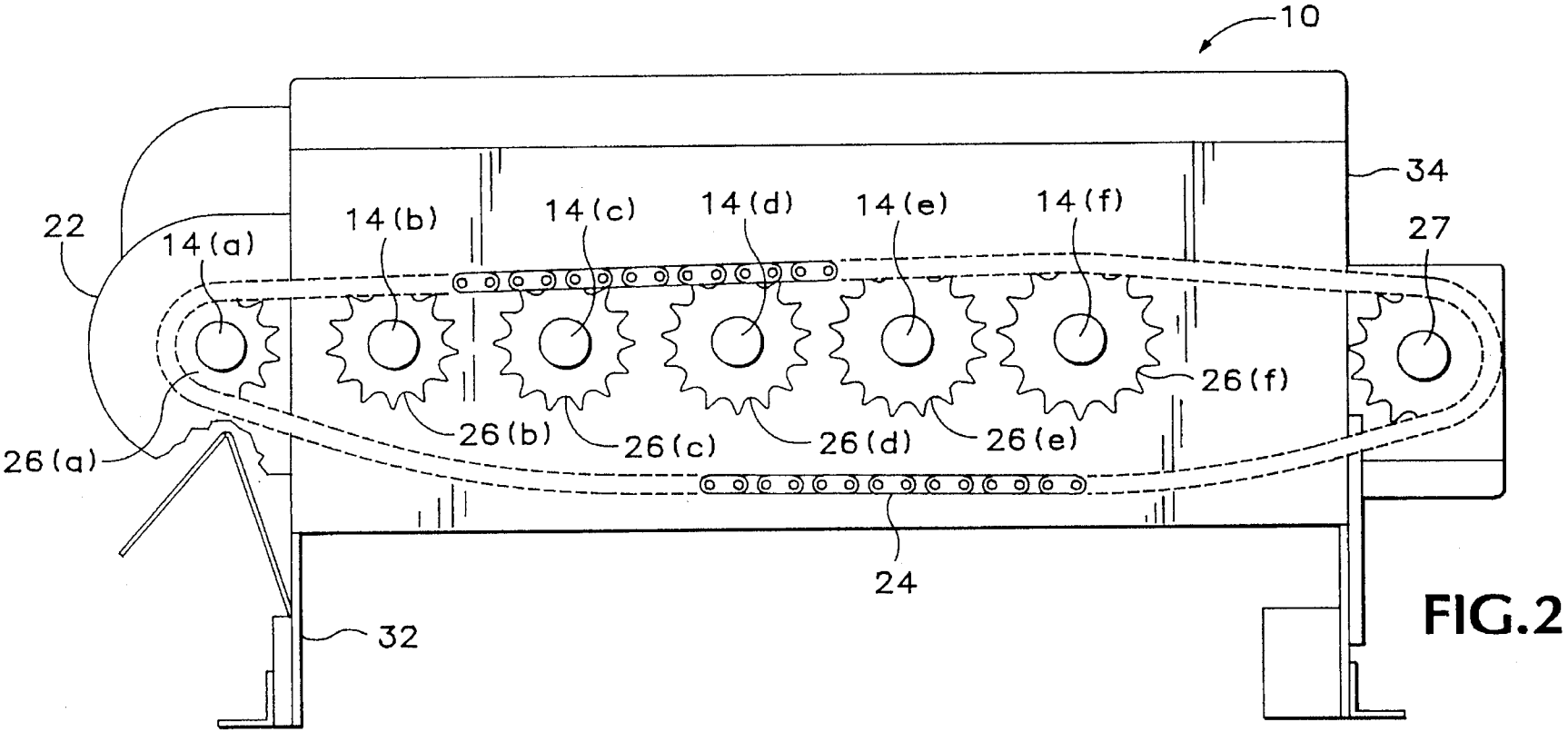
FIG. 2 is a side elevation view of the product size grading system shown in FIG. 1.

As best shown in FIG. 2 the roller bed 12 is supported on a frame 32 having side walls 34 to retain the product as it flows along the roller bed. The sprockets 26(*a*)–26(*f*) are of differing sizes and have different numbers of teeth. The lead roller shaft 14(*a*) drives a lead sprocket 26(*a*) which has the smallest number of teeth. Each of the sprockets 26(*b*)–26(*f*), from the discharge end 30 to the infeed end 28, rotate at progressively slower speeds. For example, the lead roller shaft 14(*a*) and its associated sprocket 26(*a*) rotates at 88 rpm. The sprocket 26(*a*) has twelve teeth. The next upstream sprocket 26(*b*) rotates at 81 rpm and has thirteen teeth. Each succeeding upstream sprocket 26(*c*)–26(*f*) includes one additional tooth and rotates at a slightly slower rpm. This feature of the invention has the effect of conveying the product along the roller bed 12 in such a way that the product does not become mashed or mis-sized. This could otherwise happen if the product on the roller bed 12 were to become oriented in an upright or endwise direction.

Figure 6:
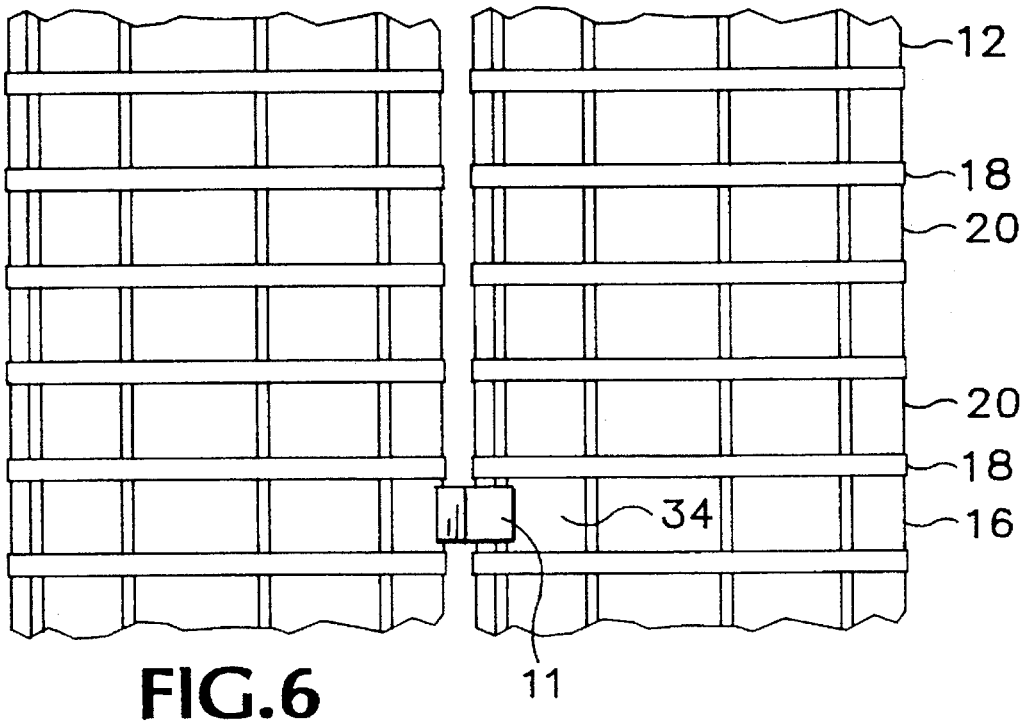
FIG. 6 is a partial top view of a roller table conveying and sizing product that becomes oriented endwise.
Figure 7:
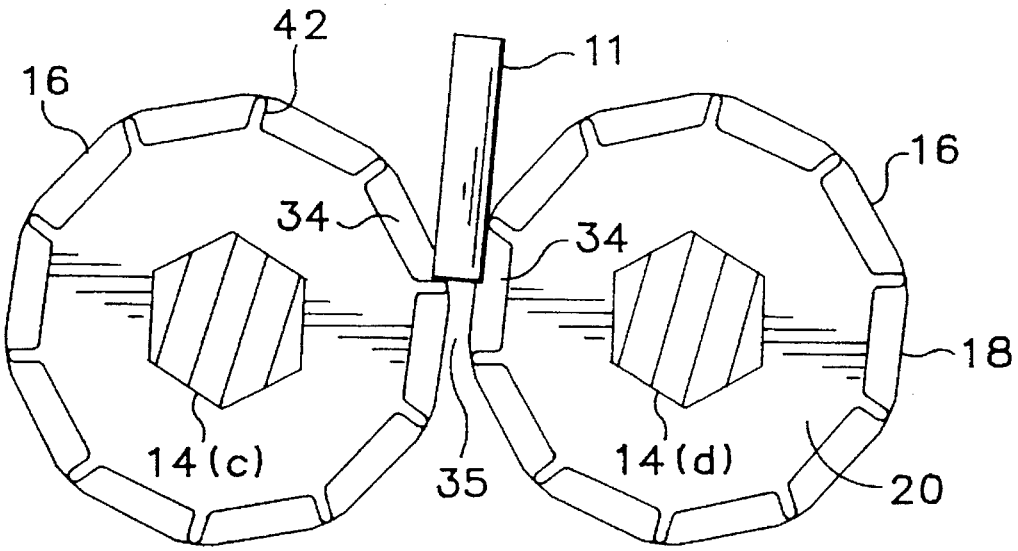
FIG. 7 is a schematic view of the operation of the invention for product that is oriented endwise.

For example, FIGS. 6 and 7, which show a portion of the roller table and two of the roller shafts 14(*c*) and 14(*d*), show the effect of the speed differential. If a piece of product 11 becomes turned up on its end and settles partially into a pocket 34, formed by the roller members 16, the rotation of the shafts 14(*a*)–14(*f*) would normally pull the product 11 down into the gap 35 between the two adjacent rollers. However, because the downstream roller shaft rotates faster than the upstream roller shaft, the downstream roller members tend to pick the product up and kick it forward faster than the infeed roller members can pull it into the gap 35.

Figure 3:
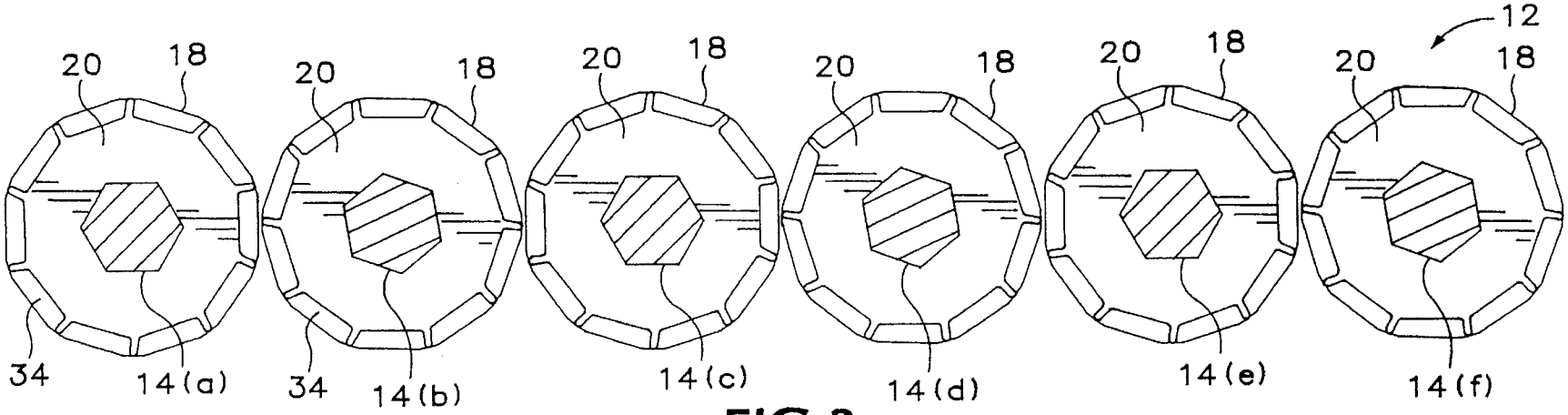
FIG. 3 is a sectional view of the roller table of FIG. 1 taken along line 3—3 in FIG. 1.
Figure 3B:
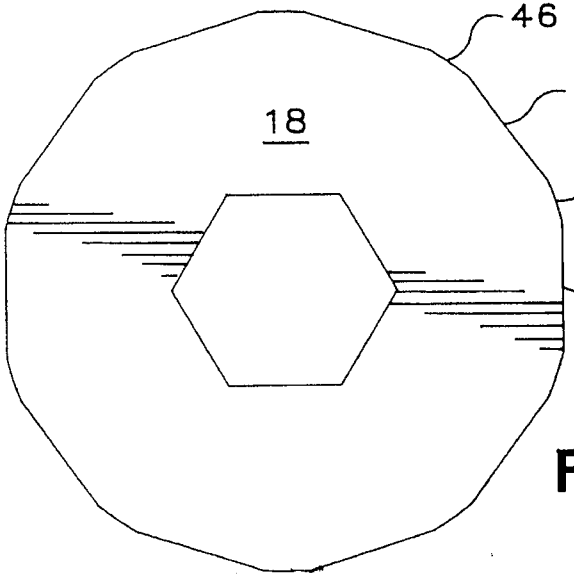
FIG. 3B is a side view of a conveyor disk.
Figure 3A:
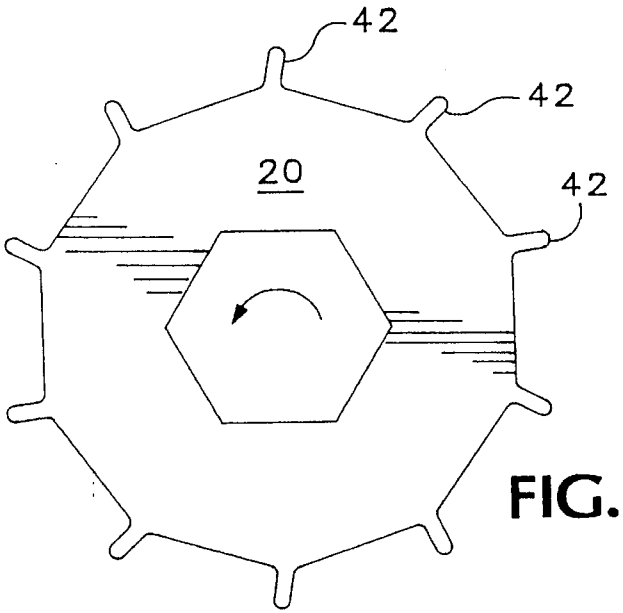
FIG. 3A is a side view of a nubbin roller.

Each roller member 16 consists essentially of a nubbin roller 20 and conveyor disks 18. The nubbin roller 20 (refer to FIG. 3A) is a relatively thick disk having a polygonal shape in cross section with small nubbins or vanes 42 projecting radially outwardly. The nubbins or vanes 42 do not project straight out along a radial line, but are inclined in a lagging direction to the direction of rotation, about 10° off radial. This gives the nubbins 42 a type of "wiper blade" action. The nubbin roller 20 is preferably made of a flexible or resilient material such as rubber so that the nubbins or vanes 42 flex so as not to damage the product. The nubbin rollers 20 are sandwiched by conveyor disks 18 (refer to FIG. 3B) which are disks, made preferably of plastic, and which are thinner than the nubbin rollers 20. The combination of two conveyor disks 18 sandwiching a nubbin roller 20 creates the pockets 34 that size the product being fed across the roller bed 12. Undersized product falls into the pockets 34 which enables these smaller pieces to slip through the gaps 35 between adjacent roller shafts and drop below the roller bed 12 into any convenient receptacle or disposal unit (not shown).

Figure 4:
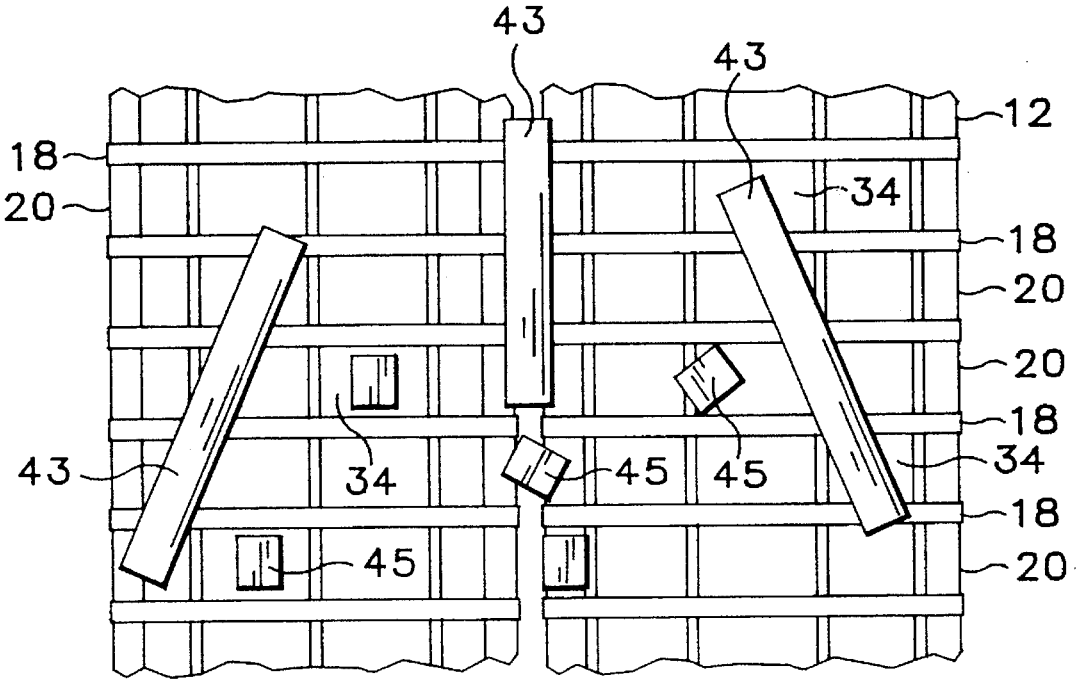
FIG. 4 is a partial top view of a roller table conveying and sizing product oriented crosswise.
Figure 5:
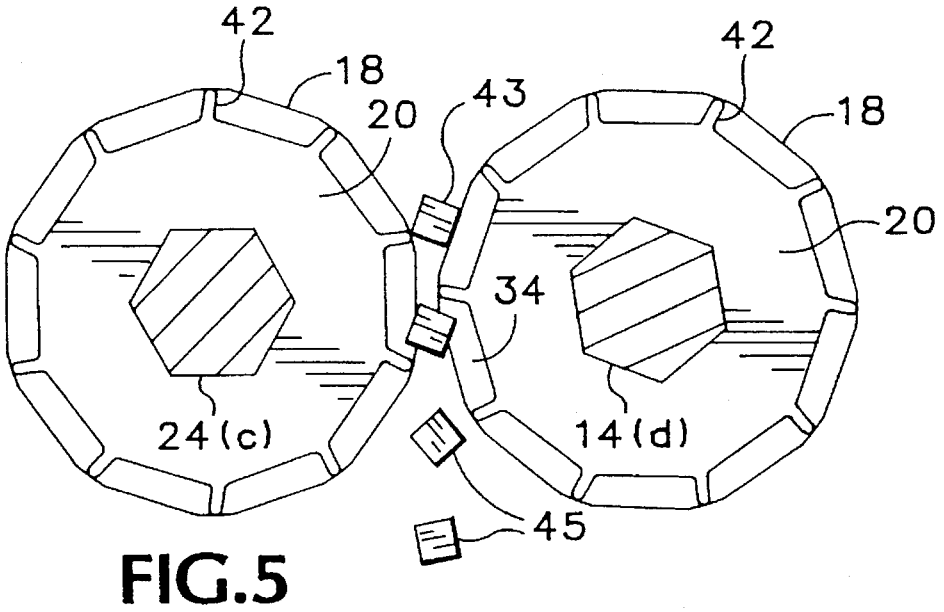
FIG. 5 is a schematic representation of two adjacent roller shafts illustrating the principal operation of the invention for product oriented crosswise.

This operation is illustrated in FIGS. 4 and 5. A properly sized product piece 43 is carried on top of the roller bed 12 by the conveyor disks 18. It is too long to slip into any of the pockets 34 formed between the conveyor disks 18 and the nubbin rollers 20. The smaller product pieces 45, however, fall into the pockets 34 and are pulled through by shaft rotation and dropped below the table. The conveyor disks 18 are polygonal in shape and have flat portions 44 alternating with rounded crown portions 46. This helps to convey properly sized product 43 along the roller table without damage. The conveying action provided by the alternating rounds and flats on the conveyor disks is an improvement over conventional rollers which have a round cross section and does not damage the product like other conveyor type rollers which may have sharp edges.

The invention is particularly useful for size grading food product such as French fried potatoes. Slivers, fines and product cut too short is highly undesirable in French fry packaging where the object is to provide uniformity of product size. Additionally, other food products may be used with the product size grading system of the invention. In particular, green beans which have been cut for packaging as frozen green beans can be used with the invention as well as carrots.

The sizing of the pockets 34 may be accomplished in various ways. First of all, the size of the nubbin roller and the selection of a polygonal shape dictates the lengthwise dimension of the pocket 34. Additionally, however, the dimension of the pocket laterally, across the roller table 12, may be controlled by selecting one or more nubbin rollers stacked together. For example, if the thickness of each nubbin roller were one-half inch, three nubbin rollers stacked together, sandwiched by two conveyor disks would provide a crosswise pocket dimension of one and one-half inches.

Although a sprocket and chain system has been shown for the motorized transmission, there are obviously many substitutions and modifications which could be made which would achieve the same effect. For example, each shaft could be coupled to its next adjacent shaft by gears where the number of gear teeth would control the speed of each shaft.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A product size grading system comprising a roller bed having a plurality of rotary shafts, each shaft having a uniform direction of rotation and supporting a plurality of alternating conveyor disks and nubbin rollers, the nubbin rollers each having a substantially polygonal cross section and having flexible nubbins projecting therefrom, wherein said nubbins are inclined at a slight angle lagging the direction of rotation of said rotary shafts and wherein the combination of said nubbin rollers and said conveyor disks form product sizing pockets.

2. The product size grading system of claim 1 wherein said slight angle is approximately 10°.

3. A product size grading system comprising:

(a) a roller bed having an input end and an output end, said roller bed having a plurality of rotary shafts;

(b) a plurality of product sizing roller members on each said rotary shaft, wherein said roller members include alternating conveyor disks and nubbin rollers, said nubbin rollers including nubbins projecting radially outwardly, said nubbins being generally aligned in a transverse direction to said conveyor disks;

(c) a transmission coupled to the plurality of rotary shafts, said transmission driving said rotary shafts in a unitary direction so as to move the product from said input end to said output end, wherein each shaft in the roller bed rotates at a different speed, the speeds becoming substantially progressively faster from the input end to the output end of said roller bed; and (d) wherein the combination of said nubbin rollers and said conveyor disks form product sizing pockets.

4. The product size grading system of claim 3 wherein the transmission comprises a chain looped over sprockets extending from each of said shafts, each of said sprockets having a different number of sprocket teeth.

5. The product size grading system of claim 3 wherein said nubbin rollers comprise a substantially polygonal disk having flexible projecting nubbins.

6. The product size grading system of claim 3 wherein at least one of said nubbins is flexible.

* * * * *